United States Patent [19]

Hanson

[11] 4,329,184

[45] May 11, 1982

[54] ROCK AGGREGATE CORE MATERIAL WASHING AND RECYCLING

[75] Inventor: David W. Hanson, Minneapolis, Minn.

[73] Assignee: Fabcon, Inc., Savage, Minn.

[21] Appl. No.: 161,456

[22] Filed: Jun. 20, 1980

[51] Int. Cl.[3] ..... B08B 3/02

[52] U.S. Cl. ..... 134/18; 134/25.1; 134/68; 134/115 R; 134/131; 264/37; 264/228; 425/215

[58] Field of Search ..... 134/10, 18, 25.1, 30, 134/68, 115 R, 133, 131; 264/37, 145, 228; 425/215, 289

[56] References Cited

U.S. PATENT DOCUMENTS

| | | | |
|---|---|---|---|
| 1,560,012 | 11/1925 | Andrews | 134/30 X |
| 2,812,622 | 11/1957 | Gorman | 134/133 X |
| 3,217,375 | 11/1965 | Kinnard | 264/228 X |
| 3,261,368 | 7/1966 | Owens et al. | 134/133 X |

*Primary Examiner*—Richard V. Fisher

*Attorney, Agent, or Firm*—Schroeder, Siegfried, Ryan, Vidas, Steffey & Arrett

[57] ABSTRACT

A process and system for recovery and recycling of hard rock core forming aggregate used in the slip forming of elongated hollow-cored concrete planks using wash water to remove slurry and a rotating screen to remove the water from the aggregate with collection and conveying means for the aggregate.

6 Claims, 2 Drawing Figures

ROCK AGGREGATE CORE MATERIAL WASHING AND RECYCLING

DESCRIPTION

Background of Prior Art

The present invention relates to an improvement in the art of forming of long-length planks of prestressed concrete which are hollow-cored. More particularly, the invention is directed to an improvement wherein the concrete bodies are in the form of elongated planks typically of widths in excess of 4′ and thicknesses typically of 8″ and have a plurality of spaced hollow cores longitudinally therein which have been formed by use of particulate material.

It is known in the art to form such bodies by the use of horizontal casting techniques. In the art a form, either moving or stationary, having side walls defining the elongated edges of the body to be cast, is used. Generally, rectangular cross-section slip-form members are utilized to provide a shaping of the plastic concrete so as to form a plurality of generally rectangularly shaped voids in the initially plastic concrete. In order to keep the concrete from collapsing into the voids once the metal slip forms that are used in providing the initial shape are removed, the cavity within the slip form is filled with some particulate material. As the slip form is removed, the particulate material is left behind and the concrete is prevented from sagging into the voids created by the slip forms by the presence of this particulate material. After the concrete is cured, the majority of the particulate material is removed from the plank by tilting the plank at an angle of about 60% so as to allow the particulate material which has not adhered to the concrete wall to pour out of the lower end. One such general procedure is described in U.S. Pat. No. 3,217,375.

The concrete planks in accordance with this art are cast in very long lengths usually on the order of ten times that of the expected length of an individual plank in its ultimately finished purpose. These planks, as cast, must be cut by means of a concrete saw into the desired length after the concrete has become sufficiently cured to maintain its own configuration, bond to prestress strand, and has sufficient strength to permit it to be lifted by means of lifting loops or the like for the dumping of the core contents and for the movement to storage of the completed plank.

During the sawing operation, conventional diamond tipped concrete saws are utilized which use water as a coolant and lubricant for the saw blade and for carrying away the material which is produced from the kerf. A considerable quantity of finely pulverized, semi-cured concrete is produced by virtue of this sawing action.

As the slip casting was initially contemplated in U.S. Pat. No. 3,217,375, the core forming material would typically be a lightweight material such as vermiculite. As the slurry was produced during the cutting action of the saw, it would tend to clog the core forming material in the area immediately adjacent the saw cut with the finely divided material. Thus, the slurry would not penetrate to any significant distance down along the hollows of the concrete on each side of the saw cut. Subsequently, when the plank sawing had been completed, the plank would be lifted and the vermiculite in the plank would be dumped into a pit for recovery and recycling. Typically, about 10% of the core forming material is left adhered to the concrete walls of the cavity with about 90% being recovered by subsequent recycling.

Other materials which found use for the core forming material such as expanded shale pellets acted in much the same way as did the vermiculite. That is, these other materials clog with the saw slurry material very close to the saw cut itself and the slurry did not penetrate any significant degree into the cores so as to wet and coat large amounts of the core material.

It became highly desirable to make use of a far less expensive material for the temporary core material in this type of slip forming operation than had been previously used. Vermiculite and expanded shale were expensive in their initial costs and the continuing loss of 10% of the material at each casting operation increased the cost of the concrete plank product undesirably. It was recognized that one could use hard rock such as ordinary river gravel (typically of ½″ to 1″ diameter) for the purpose of holding the shape of the cores once the slip forms had been removed from the plastic concrete. The core forming operation was essentially the same as it had been with the vermiculite and other materials but a quite different problem arose when attempts were made to recycle the hard rock gravel core material. Rather than clogging the region immediate adjacent the saw cutting operation, the slurry of water and partly cured concrete tended to run long distances into the cores of the plank, wetting and coating a high percentage of the rocks. When the sawing operation was completed and the plank tilted to dump out the hard rock material, the hard rock material flowed quite readily but the resultant material that was recovered had a sizable percentage of the core rock material coated with a layer of the slurry, even after drainage. When attempts were made to reuse the hard rock that had gone through a first cycling in a second use as a core material, it was found that the hard rock in such second use would not readily pour out of the plank when it was tilted and frequently it could not be removed at all. Of course, it is undesirable to retain the core material in the voids of the concrete as this adds to the weight of the finished plank, increases thermal conductivity and provides no advantages. Further, the failure to remove the hard rock in the cores means that one utilizes 100% of the core material each time, rather than about 10% as had been the case of vermiculite and other prior core materials. The problem just described above has been handled by others in the field by merely using the core forming hard rock material one time and then making use of the core material for some purposes other than as a core forming material. In some instances, the once used core material of hard rock is merely discarded while in other instances, it has been used to provide a good drainage foundation around the yards of plants of manufacturing these products.

In accordance with the present invention, it has been discovered that when the hard rock core material is used, and the core hard rock is immediately water washed following its being dumped from the finished concrete plank, the slurry material coating the rock is substantially removed and the rock can be used over and over again with the slip forming operation. Of course, as approximately 10% of the core forming rock is lost on each usage, one is gradually replacing a part of the used material at each cycling.

BRIEF DESCRIPTION OF THE DRAWINGS

The invention will be best understood with reference to the drawings wherein.

DETAILED DESCRIPTION OF THE INVENTION

Figures 1, 2:
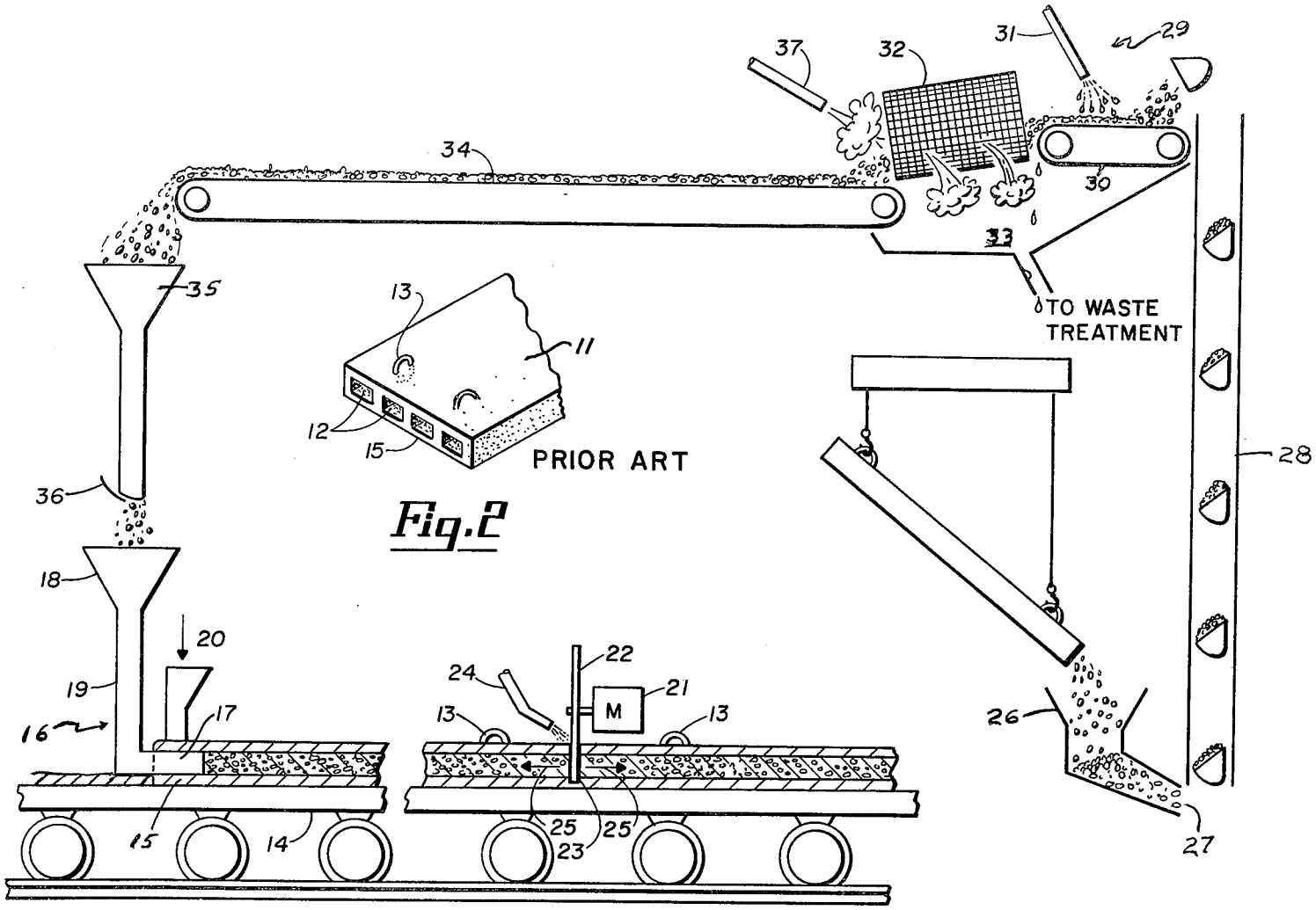
FIG. 1 shows in highly schematic form a concrete plank forming operation including the recycling steps of the hard rock core forming material recovery and reuse.
FIG. 2 is a perspective view of a concrete plank in accordance with the invention showing the cores which are typically formed in the 8′ wide section×8″ thick plank.

Referring first to FIG. 2, there is shown a concrete plank formed by the slip forming techniques in accordance with the prior art as well as the present invention. This plank consists of a body of concrete 11 which has been formed around cores 12 by use of a slip form of a type such as that described in the U.S. Pat. No. 3,217,375. A variety of techniques are available to form the cores and it should be not understood that the only techniques for so doing are in accordance with the aforesaid patent. As the slip forming technique in and of itself is not part of the present invention, it will only be discussed in general terms. The plank of FIG. 2 is also provided with some means of lifting it and tilting it. The most commonly used technique is to provide lifting loops 13 which are embedded into the concrete at the time it is poured and are held firmly in engagement with the concrete. These can be attached to hooks and a crane means to provide the necessary handling of the plank after it is formed, including the dumping operation.

Referring to FIG. 1, there is illustrated in highly schematic and partially broken away from a casting bed generally designated 14 which is of conventional form. The casting bed may be of the stationary type or it may be of a rolling bed type. In the stationary type, the casting equipment which deposits the concrete on the bed moves along the bed while in the rolling bed form, the bed moves beneath stationary casting equipment. The techniques of the present invention are equally applicable to either form but will be described only with respect to a moving bed form.

Means, not shown, are provided for depositing a soffit layer of concrete 15 on the bottom face of the bed. After this soffit layer 15 is deposited, a slip form assembly 16 is positioned in engagement with the soffit layer 15 at the lower edges of the slip forms 17 which are of a generally inverted U-shaped cross section. Core material is provided from a reservoir 18. The core material descends through the main tube 19 and is drawn out of the rear of the slip form 17 to fill the void created by the slip form. While the slip form is being moved relatively to the bed by movement to the right of the bed itself, concrete is deposited through hopper 20 from a source, not shown, over the top of slip forms 17 to provide the top layer of the concrete plank. Leveling and finishing apparatus likewise are not shown as they form no part of the present invention. The concrete plank to the right of the slip form 17 is shown in cross-sectional view to illustrate the placement of the core forming rock which at this stage of manufacture fills voids 12.

As already stated, the concrete plank is manufactured in considerable lengths usually in excess of 400′ for such a manufacturing operation. Prestressing cables are also provided and are not illustrated herein as they also form no portion of the present invention. After the plank is formed, lifting loops 13 are inserted into the still wet concrete and suitable curing methods are utilized to cure the concrete. Usually this will involve a heating chamber to accelerate the cure of the concrete. Again, as the curing forms no direct part of the present invention, it has not been shown in the drawings.

When the concrete plank has become fully cured, it is then necessary to cut the plank into the desired lengths of its ultimate intended purposes. As shown in FIG. 1, a concrete saw of conventional type is utilized for this purpose. The motor 21 drives a diamond tip saw blade 22 which cuts a kerf 23 substantially all the way through concrete plank 11. Schematically illustrated is a pipe 24 which delivers a stream of water to the side of blade 22 to aid in lubricating and keeping the blade cool as it cuts through the concrete. This combination of the water and the material being ground by the saw blade from kerf 23 produces the slurry which penetrates in the direction of arrows 25 as the plank is being sawed. As there is no way in which the water can flow straight downwardly, the water takes the path of least resistance flowing through the hollow-core area 12 around the hard rock gravel and in doing so, coats the surfaces of the gravel with slurry.

After the plank has been sawed to appropriate lengths, a hoist means lifts the plank that has been sawed from the bed by means of lifting loops 13 and tilts it as shown so as to have the hard rock core forming material pour outwardly from the lower end thereof as illustrated. The now empty plank is moved by conventional means to a storage yard where it awaits its final curing by passage of time.

The rock, which has been dumped from core molds 12, goes to a suitable collection hopper illustrated at 26 from which it is subsequently treated before being reintroduced into a core forming operation.

The rock which has been dumped into collection means 26 is preferably immediately given a high velocity washing with a jet of water to wash it substantially free of the slurry which has been collected on the surface of the rocks as a result of previously mentioned sawing operation. This washing operation can take place immediately below collection hopper 26 or preferably as shown in FIG. 1.

As shown in FIG. 1, a bucket elevator or similar means 28 picks up the rock from the collection area 27 and conveys it upwardly above the casting operation to a washing station generally designated 29. At washing station 29, the rock is dumped from conveying means 28 onto a suitable collection means. This may be a simple feed box joined to a vibrating substantially flat screen inclined at a suitable angle (about 18°) to insure movement beneath water spray heads. The vibrating screen effectively removes most of the water. The needed velocity of the wash water is readily determined by examination of the washed rock. If insufficient cleaning is achieved, the velocity is increased. If desired, a jet of air from pipe 37 can be used to drive off adhered water from the washed rock. In cold climates, this aids in lessening the possibility of the washed rock freezing into a solid mass.

Alternatively, the rock from conveyor 28 may be dumped, as shown in FIG. 1, onto a conveyor means 30 where it is washed by water from pipe 31 and then delivered to a rotating screen 32 to aid in removal of water from the rock. The washed stone is then transported into some appropriate screen means which is shown as a rotating drum 32 where the rock is tumbled or vibrated as it passes through the screen means to shake off the excess water. The water draining from this system goes to a drainage catch basin 33 which in turn is drained so that the waste water and slurry washed from the rock goes to a central treatment point which would desirably include all of the plant waste waters including that from the sawing operation. The washed rock is then conveyed by some suitable means which is illustrated as an endless conveyor belt 34 which conveys the rock back to the original holding hopper 35 which is provided with a means such as a pneumatic gate 36 for delivery of the rock back to hopper 18 of the slip form assembly.

If one attempts to reuse the rock without recycling as described above, through a washing operation, the slurry that is on the surface of the rock will bake during the accelerated cure step commonly used in the art resulting in a locking of one rock to another and thus, the individual rocks tend to be bonded together so that the rock cannot be removed from the cores. The longer the rock is allowed to stand after it has been dumped from the finished plank without washing, the greater the difficulty has been with removing this slurry coating from the individual rock.

While the invention has been described with respect to a moving bed arrangement, it will be understood that the concept is similarly applicable to a stationary bed. In the latter instance the core forming rock would typically be dumped from a finished concrete plank to movable hoppers and could then be washed to remove the slurry coating from the sawing operation. The movable hopper containing the washed and now reusable core material would then be moved to a position to transport the washed rock into a casting machine.

I claim:

1. A process for recovery and recycling of hard rock aggregate used in forming of hollow-core prestressed concrete planks wherein the hard rock aggregate from a slip form core material reservoir has been deposited into longitudinally positioned voids formed by a slip form within a plastic concrete plank and has acted to hold the plastic concrete in place while the concrete is cured and subsequently cut to desired length plank sections with a water lubricated saw that creates a finely divided saw slurry of concrete which coats said aggregate, comprising:

(a) dumping said coated hard rock aggregate from said plank sections into a collection means;

(b) delivering a stream of said coated aggregate from said collection means into the path of a jet of wash water of sufficient velocity and volume to substantially remove the saw slurry from the surface of said aggregate;

(c) draining the wash water and entrained slurry material from said aggregate; and, (d) transporting the washed aggregate to the slip form core material reservoir for ultimate reuse in the forming of hollow cores in concrete planks.

2. In a system for forming hollow core concrete plank by use of a slip form which forms hollow voids in a plastic mass of concrete in which said slip form is used to introduce core forming rock aggregate into a void within the plastic concrete and in which system means are provided for sawing said concrete plank after at least partial curing into the desired lengths thereby creating a slurry of concrete which coats said aggregate, the improvement comprising:

(a) collection means for at least temporarily holding coated rock aggregate removed from the cores of the finished concrete plank;

(b) washing means for directing a stream of water with sufficient volume and force over said removed, coated aggregate to remove substantially all of the saw slurry from said aggregate; and, (c) conveying means for returning said washed aggregate to said slip form.

3. The system in accordance with claim 2 wherein said collection means includes ramp means constructed and arranged to deliver a layer of unwashed aggregate into a stream of water from said washing means and then into a screen means for drainage of said water into a catch basin, the washed and drained aggregate passing from the screen means onto said conveying means.

4. The system in accordance with claim 3 wherein said screen means is an open ended rotating cylinder.

5. In a system for horizontally forming a hollow-core concrete plank wherein a casting bed is used in conjunction with plastic concrete depositing equipment and a slipform is utilized to form voids in deposited fluid concrete and to deposit a rock aggregate from a hopper into the voids created by the slipform in the fluid concrete and in which system water cooled sawing means is provided for sawing said concrete plank into a desired length after at least partial curing to thereby create a slurry of concrete which coats said aggregate, the improvement comprising:

(a) collection means adjacent said sawing means for collection and holding of rock aggregate removed from the cores of the finished concrete plank;

(b) means for elevating said collected aggregate to a washing station above said hopper;

(c) means at said washing station for directing a stream of water with sufficient volume and force over said aggregate to remove substantially all of the saw slurry from said aggregate;

(d) means for draining the water and entrained slurry from said aggregate; and, (e) means for conveying said washed aggregate back to said hopper.

6. The system in accordance with claim 5 wherein an air blast means is provided for directing a jet of air into said washed aggregate to aid in removal of adhered water.

* * * * *